US009248674B2

(12) United States Patent
Oshima

(10) Patent No.: US 9,248,674 B2
(45) **Date of Patent: *Feb. 2, 2016**

(54) PRINTING APPARATUS AND PRINTING METHOD

(71) Applicant: SEIKO EPSON CORPORATION, Tokyo (JP)

(72) Inventor: Toshiaki Oshima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/622,610

(22) Filed: Feb. 13, 2015

(65) Prior Publication Data

US 2015/0151557 A1 Jun. 4, 2015

Related U.S. Application Data

(63) Continuation of application No. 14/219,248, filed on Mar. 19, 2014, now Pat. No. 8,985,732.

(30) Foreign Application Priority Data

Mar. 25, 2013 (JP) ..... 2013-061561

(51) Int. Cl.

| | |
|---|---|
| ***B41J 2/01*** | (2006.01) |
| ***B41J 15/04*** | (2006.01) |
| ***B41J 13/00*** | (2006.01) |
| ***B41J 11/00*** | (2006.01) |

(52) U.S. Cl.

CPC ..... *B41J 15/04* (2013.01); *B41J 11/0015* (2013.01); *B41J 13/0009* (2013.01); *B41J 15/046* (2013.01)

(58) Field of Classification Search

CPC ..... B41J 11/007; B41J 15/04; B41J 15/042

See application file for complete search history.

(56) References Cited

U.S. PATENT DOCUMENTS

| | | | | |
|---|---|---|---|---|
| 8,985,732 | B2 * | 3/2015 | Oshima | 347/19 |
| 2011/0122189 | A1 | 5/2011 | Shigeno et al. | |

FOREIGN PATENT DOCUMENTS

| | | |
|---|---|---|
| JP | 03-046953 | 2/1991 |
| JP | 2012-200905 | 10/2012 |

OTHER PUBLICATIONS

European Search Report for Application No. 14160676.4 dated Jul. 26, 2014.

U.S. Appl. No. 14/219,248, Nov. 13, 2014, Notice of Allowance.

* cited by examiner

*Primary Examiner* — Lamson Nguyen

(74) *Attorney, Agent, or Firm* — Workman Nydegger

(57) ABSTRACT

A printing apparatus includes a rotating shaft that is displaceable in an axial direction and feeds a recording medium by rotating, a print head that prints on the recording medium that is fed from the rotating shaft, a support member that supports the recording medium between the rotating shaft and the print head, a process execution unit that performs a front surface modifying process on the recording medium supported by the support member, and a displacement mechanism that displaces the support member according to displacement of the rotating shaft.

6 Claims, 6 Drawing Sheets

PRINTING APPARATUS AND PRINTING METHOD

CROSS-REFERENCE TO RELATED APPLICATIONS

This application is a continuation application of U.S. patent application Ser. No. 14/219,248, filed Mar. 19, 2014, which patent application is incorporated herein by reference in its entirety. U.S. patent application Ser. No. 14/219,248 claims the benefit of and priority to Japanese Patent Application No. 2013-061561 filed Mar. 25, 2013, the contents of which are hereby incorporated by reference in its entirety.

BACKGROUND

1. Technical Field

The present invention relates to a printing apparatus and a printing method for printing on a recording medium by a print head by feeding the recording medium to the print head using a rotating shaft that feeds the recording medium by rotating so that a position of the recording medium that is fed to the print head is adjusted by displacing the rotating shaft in an axial direction.

2. Related Art

An apparatus for printing by an ink ejecting head on a recording medium by feeding the recording medium wound in a roll shape from a paper feeding unit to the ink ejecting head is illustrated in FIG. 6 of JP-A-2012-200905. Further, a corona discharging device that faces a counter electrode disposed between the paper feeding unit and the ink ejecting head is provided in the apparatus for printing according to JP-A-2012-200905. In addition, the corona discharging device performs a corona process which is a kind of front surface modifying process on the recording medium supported by the counter electrode.

However, if a recording medium is fed to a print head (ink ejecting head) using a mechanism such as the paper feeding unit that feeds the recording medium by rotating a rotating shaft that supports the recording medium, printing is not appropriately performed on the recording medium since the recording medium may be fed to the print head in a state where position deviation of the recording medium occurs in an axial direction of the rotating shaft. In contrast, the position of the recording medium from the rotating shaft to the print head is adjusted in the axial direction by displacing the rotating shaft in the axial direction so that the position deviation of the recording medium that is fed to the print head can be suppressed. However, as disclosed in JP-A-2012-200905, there is a concern that if a support member that supports the recording medium subjected to the front surface modifying process is provided between the rotating shaft and the print head, the recording medium is interrupted by friction force working between the support member and the recording medium so that the recording medium is not smoothly displaced according to the displacement of the rotating shaft and the position of the recording medium that is fed to the print head is not appropriately adjusted.

SUMMARY

An advantage of some aspects of the invention is to provide a technique in which a recording medium can be smoothly displaced according to displacement of a rotating shaft in an axial direction and a position of the recording medium that is fed to a print head can be appropriately controlled in a configuration in which a support member that supports the recording medium subjected to a front surface modifying process is provided between the rotating shaft that feeds the recording medium and the print head.

According to an aspect of the invention, there is provided a printing apparatus which includes a rotating shaft that is displacably provided in an axial direction and feeds a recording medium by rotating, a print head that prints on the recording medium that is fed from the rotating shaft, a support member that supports the recording medium between the rotating shaft and the print head, a process execution unit that performs a front surface modifying process on the recording medium supported by the support member, and a displacement mechanism that displaces the support member according to displacement of the rotating shaft.

According to another aspect of the invention, there is provided a printing method for printing by a print head on a recording medium that is fed from a rotating shaft to the print head which includes feeding the recording medium by displacing the rotating shaft in an axial direction and rotating the rotating shaft, performing a front surface modifying process on the recording medium supported by a support member between the rotating shaft and the print head, and printing by the print head on the recording medium that is fed to the print head after being subjected to the front surface modifying process, so that the support member is displaced according to displacement of the rotating shaft.

In the printing apparatus and the printing method configured as above, the support member that supports the recording medium subjected to the front surface modifying process between the rotating shaft and the print head is displaced according to displacement of the rotating shaft that feeds the recording medium. Accordingly, since the support member is also displaced if the rotating shaft is displaced, interruption by the support member of displacement of the recording medium accompanied by the displacement of the rotating shaft can be suppressed. As a result, it is possible to appropriately control a position of the recording medium that is fed to the print head by smoothly displacing the recording medium according to the displacement of the rotating shaft in the axial direction.

At this point, the printing apparatus may be configured so that the process execution unit is displaced according to the displacement of the support member. That is, if the recording medium is displaced according to the displacement of the support member, a positional relationship between the process execution unit and the recording medium could be changed so the front surface modifying process by the process execution unit is affected. In contrast, if the process execution unit is displaced according to the displacement of the support unit, it is possible to suppress the change in the positional relationship between the process execution unit and the recording medium and stably perform the front surface modifying process.

Additionally, various aspects can be considered for a specific configuration of a displacement mechanism for displacing a support member according to displacement of a rotating shaft. Accordingly, the displacement mechanism may include a drive unit that displaces the support member according to displacement of a rotating shaft by integrally driving the rotating shaft and the support member. Otherwise, the displacement mechanism may include a drive unit that displaces the support member according to the displacement of the rotating shaft by independently driving the rotating shaft and the support member.

In addition, the printing apparatus may further include a nip portion that nips the recording medium with a pair of rollers disposed between the rotating shaft and the print head so that the support member supports the recording medium between the rotating shaft and the nip portion. In a configuration in which the recording medium is nipped by the nip portion between the rotating shaft and the print head in this manner, the position of the recording medium from the nip portion to the rotating shaft is adjusted according to the displacement of the rotating shaft, and the change in the position of the recording medium from the nip portion to the print head is suppressed by nipping so that the feeding of the recording medium to the print head can be stably performed. That is, the recording medium of which the position is adjusted until the recording medium reaches the nip portion can be stably fed from the nip portion to the print head. Further, the support member provided between the rotating shaft and the nip portion in order to support the recording medium subjected to the front surface modifying process is displaced according to the displacement of the rotating shaft. Therefore, the position of the recording medium is appropriately adjusted until the recording medium reaches the nip portion without being interrupted by the support member and further the recording medium can be stably fed from the nip portion to the print head. As a result, the position of the recording medium that is fed to the print head can be controlled more appropriately.

Alternatively, the printing apparatus may further include a drive roller that supports the recording medium between the rotating shaft and the print head and feeds the recording medium to the print head, so that the support member supports the recording medium between the rotating shaft and the drive roller. In a configuration in which the drive roller supports the recording medium between the rotating shaft and the print head and feeds the recording medium to the print head in this manner, the position of the recording medium from the drive roller to the rotating shaft is adjusted according to the displacement of the rotating shaft and the feeding of the recording medium to the print head can be stably performed by driving the drive roller from the drive roller to the print head. That is, the recording medium of which the position is adjusted until the recording medium reaches the drive roller can be stably fed from the drive roller to the print head. Further, the support member provided between the rotating shaft and the drive roller in order to support the recording medium subjected to the front surface modifying process is displaced according to the displacement of the rotating shaft. Therefore, the position of the recording medium is appropriately adjusted until the recording medium reaches the drive roller without being interrupted by the support member, and also the recording medium can be stably fed from the drive roller to the print head. As a result, the position of the recording medium that is fed to the print head can be controlled more appropriately.

Further, the printing apparatus may further include a detection unit that detects a position of the recording medium in the axial direction so that the displacement amount of the rotating shaft in the axial direction is controlled based on a detection result of the detection unit. According to the configuration, the position of the recording medium can be adjusted with high accuracy so that the position of the recording medium that is fed to the print head can be controlled appropriately.

BRIEF DESCRIPTION OF THE DRAWINGS

Embodiments of the invention will now be described by way of example only with reference to the accompanying drawings, wherein like numbers reference like elements.

DESCRIPTION OF EXEMPLARY EMBODIMENTS

Figure 1:
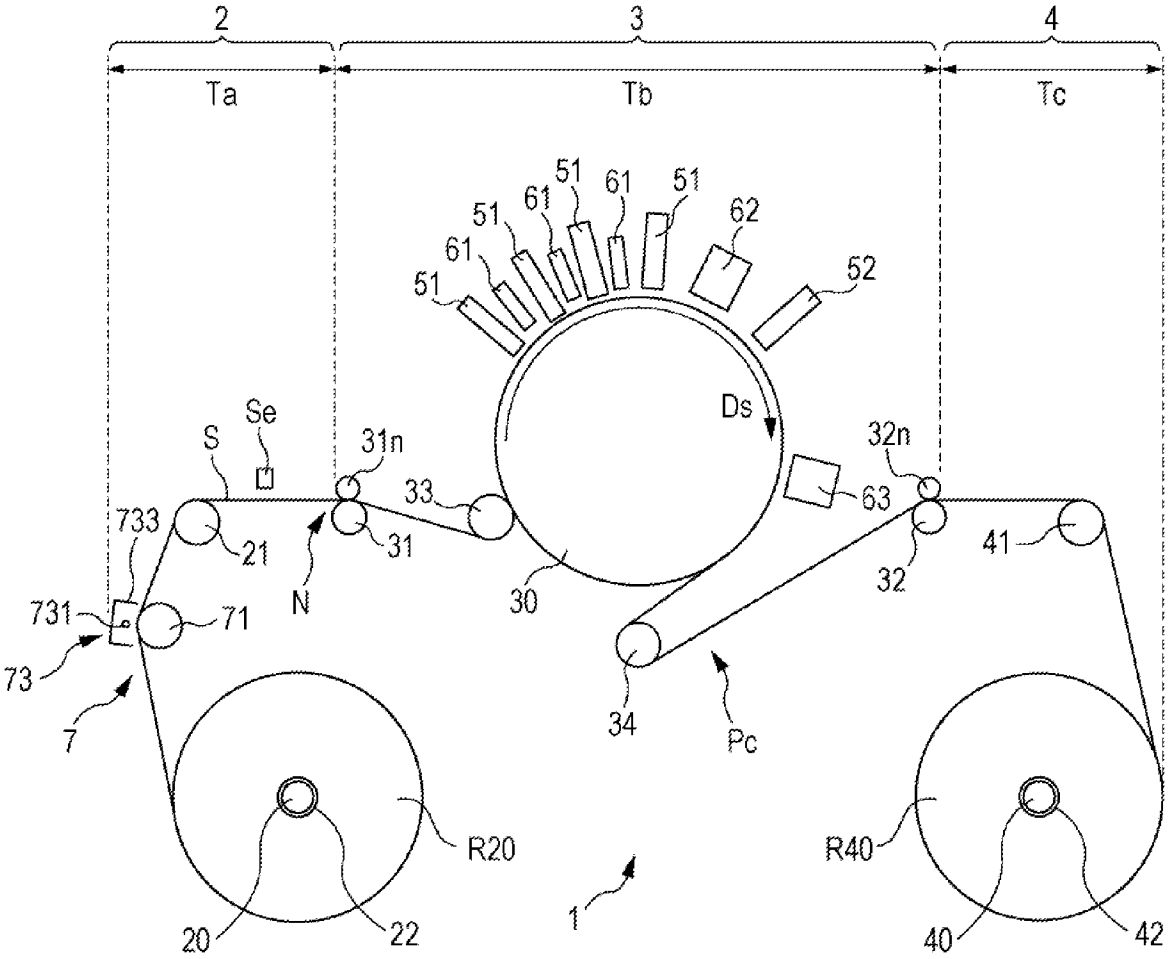
FIG. 1 is a diagram illustrating a configuration of devices included in a printer to which the invention can be applied.

FIG. 1 is a front view schematically illustrating an example of an inside structure of a printer to which the invention can be applied. As illustrated in FIG. 1, in a printer 1, one sheet S (web) of which both ends are wound around a feeding shaft 20 and a winding shaft 40 in a roll shape is stretched between the feeding shaft 20 and the winding shaft 40, and the sheet S is transported from the feeding shaft 20 to the winding shaft 40 along a transportation path Pc that stretches in this manner. In other words, a feed roller R20 and a winding roller R40 are formed such that both ends of the sheet S in the transportation path Pc are wound in a roll shape. Therefore, the sheet S is transported from the feed roller R20 supported by the feeding shaft 20 to the winding roller R40 supported by the winding shaft 40 in a roll-to-roll manner.

Further, in the printer 1, an image is recorded on the sheet S transported along the transportation path Pc. The kind of sheet S is broadly classified into paper and a film. As specific examples, the paper may include pure paper, cast paper, art paper, coated paper, and the like, and the film may include synthetic paper, Polyethylene terephthalate (PET), polypropylene (PP), and the like. Schematically, the printer 1 includes a feed unit 2 (a feed area) that feeds the sheet S from the feeding shaft 20, a process unit 3 (a process area) that records an image on the sheet S that is fed by the feed unit 2, and a winding unit 4 (a winding area) that winds the sheet S on which the image is recorded by the process unit 3 around the winding shaft 40. In addition, in the description below, among the surfaces of the sheet S, a surface on which an image is recorded is referred to as a front surface, and the other surface is referred to as a back surface.

The feed unit 2 has the feeding shaft 20 around which an end of the sheet S is wound, and a driven roller 21 that winds the sheet S pulled out from the feeding shaft 20. The feeding shaft 20 supports the sheet S by winding an end of the sheet S in a state in which the front surface of the sheet S faces outside. Further, the feeding shaft 20 rotates in a clockwise direction of FIG. 1 so that the sheet S wound around the feeding shaft 20 is fed through the driven roller 21 to the process unit 3. In addition, the sheet S is wound around the feeding shaft 20 interposing a core tube 22 detachably provided to the feeding shaft 20. Accordingly, when the sheet S of the feeding shaft 20 is used up, a new core tube 22 around which the sheet S is wound in a roll shape is mounted on the feeding shaft 20 so that the sheet S of the feeding shaft 20 can be replaced.

Further, in the feed unit 2, a corona processing device 7 is provided between the feeding shaft 20 and the driven roller 21 in the transportation path Pc of the sheet S. The corona processing device 7 has a support roller 71 that winds the sheet S reaching the driven roller 21 from the feeding shaft 20 on the back surface and a corona charger 73 that faces the support roller 71, thereby interposing the sheet S. The support roller 71 is grounded and functions as an earth electrode. Meanwhile, the corona charger 73 has a corona discharge electrode 731 and an electrode cover 733 that covers the corona discharge electrode 731. The corona discharge electrode 731 is disposed to face the support roller 71 interposing the sheet S, and causes a corona discharge to occur between the corona discharge electrode 731 and the support roller 71 when receiving an application of a voltage. A corona process (a front surface modifying process) is performed on the front surface of the sheet S that is wound around the support roller 71 by the corona discharge.

Figure 2:
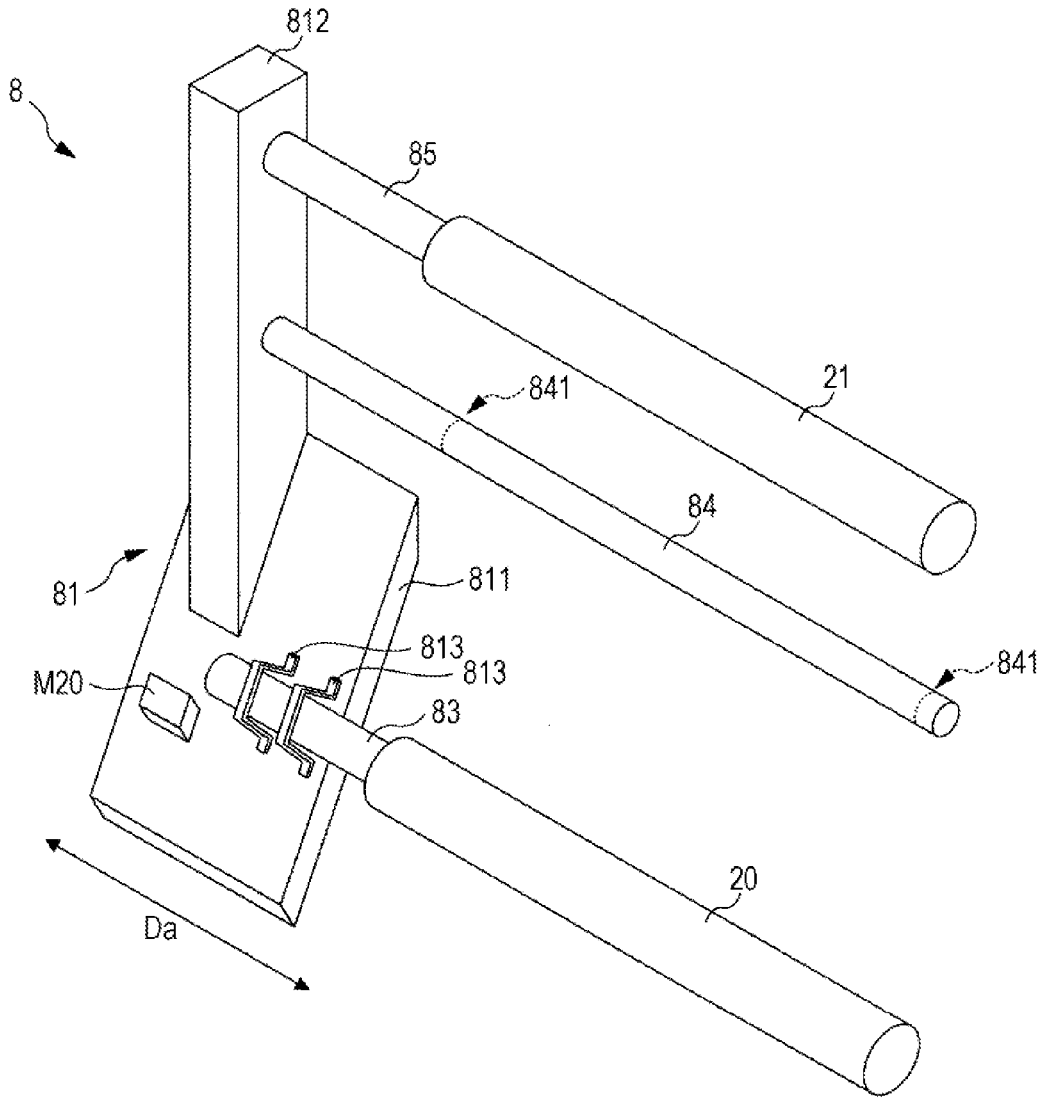
FIG. 2 is a diagram illustrating a steering mechanism that displaces a rotating shaft, a corona processing device, and a driven roller.
Figure 3:
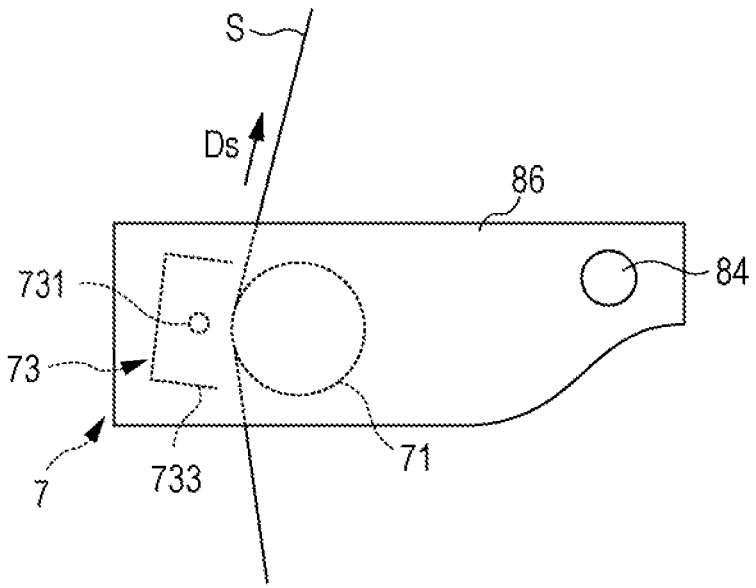
FIG. 3 is a diagram illustrating a state of supporting a corona processing device by the steering mechanism of FIG. 2.

The feeding shaft 20, the corona processing device 7, and the driven roller 21 provided in the feed unit 2 are integrally displaceable in an axial direction of the feeding shaft 20 (in other words, in a width direction of the sheet S that intersects a transportation direction of the sheet S). FIG. 2 is a perspective view schematically illustrating a structure of a steering mechanism that displaces a rotating shaft, a corona processing device, and a driven roller. FIG. 3 is a front view schematically illustrating an example of supporting a corona processing device by the steering mechanism of FIG. 2. Further, in FIG. 3, portions hidden by mounting flat plates 86 described below in the front view (the corona processing device 7 and a part of the sheet S) are illustrated by dashed lines.

As illustrated in FIG. 2, a steering mechanism 8 has a movable support member 81 displaceable in an axial direction Da of the feeding shaft 20. The movable support member 81 has a movable plate 811 displaceably supported in the axial direction Da inside the printer 1 and a pillar member 812 provided in the upper direction from the movable plate 811 and displaced in the axial direction Da integrally with the movable plate 811. The movable support member 81 supports three shafts 83, 84, and 85 that extend in the axial direction Da parallel to one another.

The shaft 83 is mounted on the movable plate 811 by mounting members 813, and rotatably supports the feeding shaft 20. Further, a feed motor M20 is adjacent to the shaft 83 and mounted on the movable plate 811. Further, the feeding shaft 20 rotates by receiving driving force from the feed motor M20 so that the sheet S is fed from the feeding shaft 20 in a transportation direction Ds intersecting the axial direction Da.

The shaft 84 is mounted in the center of the pillar member 812 and positioned between the feeding shaft 20 and the driven roller 21 in a vertical direction. Additionally, the corona processing device 7 described above is mounted on the shaft 84. Specifically, two shaft mounting portions 841 are provided on the shaft 84 with a space corresponding to a width of the corona processing device 7 in the axial direction Da, and the mounting flat plates 86 illustrated in FIG. 3 are fixed to each of the shaft mounting portions 841. The corona processing device 7 is interposed between the mounting flat plates 86 and supported by the movable support member 81. Additionally, the sheet S fed from the feeding shaft 20 passes between the corona charger 73 and the support roller 71 supported by the movable support member 81 in the transportation direction Ds and is subjected to a corona process.

The shaft 85 is mounted at a top end of the pillar member 812 and rotatably supports the driven roller 21. Further, since the shafts 83, 84, and 85 described above are parallel to one another, the driven roller 21 is supported parallel to the feeding shaft 20 and the support roller 71. In addition, the sheet S that is fed from the feeding shaft 20 and passes through the corona processing device 7 is fed through (via) the driven roller 21 to the process unit 3.

In this manner, the movable support member 81 of the steering mechanism 8 supports the feeding shaft 20, the corona processing device 7, and the driven roller 21 in an integrated manner. Further, the movable support member 81 is provided displacably in the axial direction Da. Accordingly, the movable support member 81 is driven in the axial direction Da by an axial direction drive motor Ma (FIG. 4) described below so that the feeding shaft 20 can be displaced in the axial direction Da and also the corona processing device 7 and the driven roller 21 can be displaced in the axial direction Da integrally with the feeding shaft 20. Further, a position of the sheet S is adjusted in the axial direction Da by displacing the feeding shaft 20. Accordingly, the sheet S of which the position is adjusted by the feed unit 2 is fed to the process unit 3. In addition, as described below, the position of the sheet S is adjusted by performing feedback control on a displacement amount of the feeding shaft 20 based on a result obtained by detecting an end of the sheet in the axial direction Da by an edge sensor Se disposed between the driven roller 21 and a front drive roller 31.

The process unit 3 supports the sheet S fed from the feed unit 2 by a rotating drum 30 and appropriately performs processes by function units 51, 52, 61, 62, and 63 arranged along a circumference surface of the rotating drum 30 to record an image on the sheet S. In the process unit 3, the front drive roller 31 and a rear drive roller 32 are provided on both sides of the rotating drum 30, and the sheet S transported from the front drive roller 31 to the rear drive roller 32 is supported by the rotating drum 30 to be subjected to image recording.

The front drive roller 31 has a plurality of fine protrusions formed by thermal spraying on a circumference surface, and supports the sheet S fed from the feed unit 2 on the back surface. Accordingly, the front drive roller 31 rotates in the clockwise direction of FIG. 1 so that the sheet S fed from the feed unit 2 is transported to the downstream side of a transportation path. In addition, a nip roller 31*n* is provided against the front drive roller 31. The nip roller 31*n* is in contact with the front surface of the sheet S in a state of being biased to the front drive roller 31, and interposes the sheet S between the nip roller 31*n* and the front drive roller 31. According to this, friction force between the front drive roller 31 and the sheet S is secured and the sheet S can be definitely transported by the front drive roller 31. In this manner, a nip portion N that nips the sheet S is formed with a pair of the rollers 31 and 31*n*.

For example, the rotating drum 30 is a cylindrical drum having a diameter of 400 mm and rotatably supported by a supporting mechanism (not illustrated), and winds the sheet S transported from the front drive roller 31 to the rear drive roller 32 on the back surface. The rotating drum 30 is driven to rotate in the transportation direction Ds of the sheet S that receives friction force between the rotating drum 30 and the sheet S, and supports the sheet S on the back surface. Additionally, driven rollers 33 and 34 that fold back the sheet S on the both sides of a portion wound around the rotating drum 30 are provided in the process unit 3. Among these, the driven roller 33 winds the front surface of the sheet S between the front drive roller 31 and the rotating drum 30 to fold back the sheet S. Meanwhile, the driven roller 34 winds the front surface of the sheet S between the rotating drum 30 and the rear drive roller 32 to fold back the sheet S. In this manner, the sheet S is folded back against the rotating drum 30 at each of the upstream and downstream sides in the transportation direction Ds so that the portion of the sheet S wound around the rotating drum 30 can be secured to be long.

The rear drive roller 32 has a plurality of fine protrusions formed by thermal spraying on a circumference surface, and supports the sheet S transported from the rotating drum 30 through the driven roller 34 on the back surface. Further, the rear drive roller 32 transports the sheet S to the winding unit 4 by rotating in the clockwise direction of FIG. 1. In addition, a nip roller 32*n* is provided against the rear drive roller 32. The nip roller 32*n* is in contact with the front surface of the sheet S in a state of being biased to the rear drive roller 32 and interposes the sheet S between the nip roller 32*n* and the rear drive roller 32. According to this, friction force between the rear drive roller 32 and the sheet S can be secured, and the sheet S can be reliably transported by the rear drive roller 32.

In this manner, the sheet S transported from the front drive roller 31 to the rear drive roller 32 is supported by the circumference surface of the rotating drum 30. Further, a plurality of recording heads 51 corresponding to colors different from each other are arranged in the process unit 3 in order to record a color image on the front surface of the sheet S supported by the rotating drum 30. Specifically, four recording heads 51 corresponding to yellow, cyan, magenta, and black are lined up in the transportation direction Ds in this color sequence. The recording heads 51 face the front surface of the sheet S wound around the rotating drum 30 with a slight clearance, and eject ink of the corresponding colors (colored ink) from nozzles in an ink jet method. In addition, the recording heads 51 eject ink to the sheet S transported in the transportation direction Ds so that a color image is formed on the front surface of the sheet S.

Further, UV (ultraviolet) ink (photo curing ink) that is cured by radiating an ultraviolet ray (light) is used as the ink. Thus, UV irradiators 61 and 62 (light irradiating units) are provided in the process unit 3 in order to cure the ink and fix the ink to the sheet S. In addition, the curing of the ink is performed in two steps of preliminary curing and main curing. The UV irradiators 61 for the preliminary curing are arranged in spaces between the plurality of recording heads 51. That is, the UV irradiators 61 radiate ultraviolet rays in a small integrated amount so that the ink is cured to a degree in which an ink shape is not broken down (preliminary curing), and the ink is not completely cured. Meanwhile, the UV irradiator 62 for main curing is provided at the downstream side of the plurality of the recording heads 51 in the transportation direction Ds. That is, the UV irradiator 62 radiates an ultraviolet ray in an integrated amount more than the UV irradiators 61 so that the ink is completely cured (main curing).

In this manner, the UV irradiators 61 arranged in the spaces between the plurality of recording heads 51 perform preliminary curing on colored ink ejected to the sheet S from the recording heads 51 at the upstream side in the transportation direction Ds. Accordingly, ink ejected by one of the recording heads 51 to the sheet S is subjected to preliminary curing until the ejected ink reaches another recording head 51 adjacent to the one recording head 51 at the downstream side in the transportation direction Ds. According to this, occurrence of color mixture in which colored ink is mixed with different colored ink is suppressed. In a state in which the color mixture is suppressed, the plurality of recording heads 51 eject colored ink with colors different from one another so that a color image is formed on the sheet S. Further, the UV irradiator 62 for main curing is provided at the downstream side of the plurality of recording heads 51 in the transportation direction Ds. For this, the color image formed by the plurality of recording heads 51 is subjected to the main curing by the UV irradiator 62 and fixed on the sheet S.

Further, a recording head 52 is provided at the downstream side of the UV irradiator 62 in the transportation direction Ds. The recording head 52 faces the front surface of the sheet S wound around the rotating drum 30 with some clearance, and ejects transparent UV ink from a nozzle to the front surface of the sheet S in the ink jet method. That is, the transparent ink is further ejected to the color image formed by the recording heads 51 for four colors. The transparent ink is ejected to the entire surface of the color image so as to give glossy or matte texture to the color image. Further, a UV irradiator 63 is provided at the downstream side of the recording head 52 in the transportation direction Ds. The UV irradiator 63 completely cures the transparent ink ejected by the recording head 52 by radiating a strong ultraviolet ray (main curing). According to this, the transparent ink can be fixed on the front surface of the sheet S.

In this manner, in the process unit 3, with respect to the sheet S wound around the circumference portion of the rotating drum 30, ink is appropriately ejected and cured and a color image on which the transparent ink is coated is formed. The sheet S on which the color image is printed by the process unit 3 is subjected to a front surface modifying process in advance before being fed to the recording heads 51 and 52. That is, since the color image is formed by ejecting ink to the sheet S subjected to the front surface modifying process, the good quality color image can be formed. Further, the sheet S on which the color image is formed is transported to the winding unit 4 by the rear drive roller 32.

In addition to the winding shaft 40 that winds an end of the sheet S, the winding unit 4 has a driven roller 41 that is provided between the winding shaft 40 and the rear drive roller 32 and winds the sheet S on the back surface. The winding shaft 40 supports the sheet S by winding an end of the sheet S in a state in which the front surface of the sheet S faces outside. That is, when the winding shaft 40 rotates in the clockwise direction of FIG. 1, the sheet S transported from the rear drive roller 32 passes through the driven roller 41 and is wound around the winding shaft 40. In addition, the sheet S is wound around the winding shaft 40 interposing a core tube 42 detachably attached to the winding shaft 40. Accordingly, when the sheet S wound around the winding shaft 40 is full, the sheet S together with the core tube 42 can be taken out.

Figure 4:
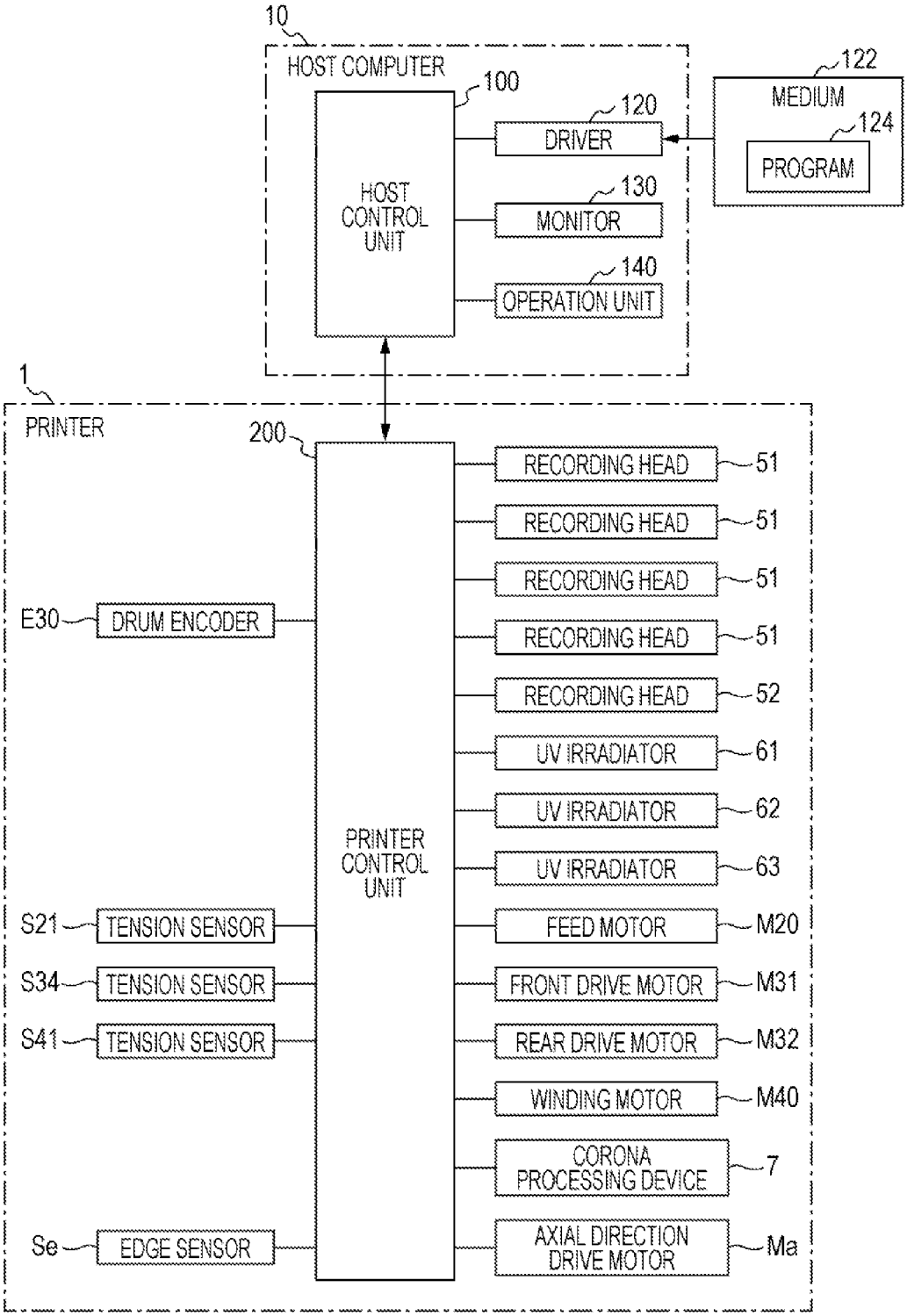
FIG. 4 is a block diagram schematically illustrating an electrical configuration for controlling the printer illustrated in FIG. 1.

The configuration of the devices included in the printer 1 has been outlined as described above. Subsequently, an electrical configuration for controlling the printer 1 is described as follows. FIG. 4 is a block diagram schematically illustrating an electrical configuration for controlling the printer illustrated in FIG. 1. The operation of the printer 1 described above is controlled by a host computer 10 illustrated in FIG. 4. In the host computer 10, a host control unit 100 that integrates control operations includes a Central Processing Unit (CPU) and a memory. In addition, a driver 120 is provided to the host computer 10, and the driver 120 reads a program 124 from a medium 122. In addition, various mediums such as a Compact Disc (CD), a Digital Versatile Disc (DVD), and a Universal Serial Bus (USB) memory can be used as the medium 122. Further, the host control unit 100 controls each part in the host computer 10 and controls an operation of the printer 1 based on the program 124 read from the medium 122.

Further, the host computer 10 is provided with a monitor 130 including a liquid crystal display and the like and an operation unit 140 including a keyboard and a mouse, as an interface with an operator. In addition to an image of a printing target, a menu screen is displayed on the monitor 130. Accordingly, the operator checks the monitor 130 and operates the operation unit 140 to open a printing setting screen from the menu screen and set various types of printing conditions such as a type of recording medium, a size of the recording medium, and printing quality. Further, a specific configuration of the interface of the operator can be modified in various manners. For example, a touch panel display may be used as the monitor 130, and the operation unit 140 may be configured by the touch panel of the monitor 130.

Meanwhile, the printer 1 is provided with a printer control unit 200 that controls each part in the printer 1 in response to an instruction from the host computer 10. Further, the recording heads, the UV irradiators, and units in an device relating to sheet transportation are controlled by the printer control unit 200. Detailed control of each unit in the device by the printer control unit 200 is described as follows.

The printer control unit 200 controls an ink ejecting timing of each of the recording heads 51 for forming a color image according to the transportation of the sheet S. Specifically, the control of the ink ejecting timings is performed based on an output (detection value) of a drum encoder E30 that is mounted on a rotating shaft of the rotating drum 30 and detects a rotating position of the rotating drum 30. That is, since the rotating drum 30 is driven to rotate corresponding to the transportation of the sheet S, the transportation position of the sheet S can be found out by referring to the output of the drum encoder E30 that detects the rotating position of the rotating drum 30. Then, the printer control unit 200 generates a pts (print timing signal) signal from the output of the drum encoder E30 and controls the ink ejecting timing of each of the recording heads 51 based on the pts signal so that the ink ejected by each of the recording heads 51 is impacted on a target position of the transported sheet S to form a color image.

In addition, the timing at which the recording head 52 ejects the transparent ink is controlled by the printer control unit 200 based on the output of the drum encoder E30 in the same manner. According to this, the transparent ink can be correctly ejected to the color image formed by the plurality of recording heads 51. Further, on and off timings of the UV irradiators 61, 62, and 63 and the amount of the radiated light are controlled by the printer control unit 200.

In addition, the printer control unit 200 administers a function of controlling the transportation of the sheet S described below with reference to FIG. 1. That is, a motor is connected to each of the feeding shaft 20, the front drive roller 31, the rear drive roller 32, and the winding shaft 40 among members configuring a sheet transportation system. Further, the printer control unit 200 rotates the motors and also controls speed and torque of each motor to control the transportation of the sheet S. Detailed control of the transportation of the sheet S is as described below.

The printer control unit 200 rotates the feed motor M20 that drives the feeding shaft 20 to supply the sheet S from the feeding shaft 20 to the front drive roller 31. At this point, the printer control unit 200 controls torque of the feed motor M20 to adjust a tension of the sheet S from the feeding shaft 20 to the front drive roller 31 (a feed tension Ta). That is, a tension sensor S21 that detects the feed tension Ta is mounted on the driven roller 21 disposed between the feeding shaft 20 and the front drive roller 31. For example, the tension sensor S21 can be configured with a load cell that detects force received from the sheet S. Additionally, the printer control unit 200 performs feedback control on the torque of the feed motor M20 based on the detection result of the tension sensor S21 to adjust the feed tension Ta of the sheet S.

In addition, the printer control unit 200 rotates a front drive motor M31 that drives the front drive roller 31 and a rear drive motor M32 that drives the rear drive roller 32. According to this, the sheet S fed from the feed unit 2 passes through the process unit 3. At this point, speed control is performed on the front drive motor M31 and torque control is performed on the rear drive motor M32. That is, the printer control unit 200 adjusts the rotational speed of the front drive motor M31 to be constant based on an encoder output of the front drive motor M31. According to this, the sheet S is transported at constant speed by the front drive roller 31.

Meanwhile, the printer control unit 200 controls torque of the rear drive motor M32 to adjust a tension of the sheet S from the front drive roller 31 to the rear drive roller 32 (a process tension Tb). That is, a tension sensor S34 that detects the process tension Tb is mounted on the driven roller 34 disposed between the rotating drum 30 and the rear drive roller 32. For example, the tension sensor S34 can be configured with a load cell that detects force received from the sheet S. In addition, the printer control unit 200 performs feedback control on the torque of the rear drive motor M32 based on the detection result of the tension sensor S34 to adjust the process tension Tb of the sheet S.

Further, the printer control unit 200 rotates a winding motor M40 that drives the winding shaft 40 to wind the sheet S transported by the rear drive roller 32 around the winding shaft 40. At this point, the printer control unit 200 controls torque of the winding motor M40 to adjust a tension of the sheet S from the rear drive roller 32 to the winding shaft 40 (a winding tension Tc). That is, a tension sensor S41 that detects the winding tension Tc is mounted on the driven roller 41 disposed between the rear drive roller 32 and the winding shaft 40. For example, the tension sensor S41 can be configured with a load cell that detects force received from the sheet S. Further, the printer control unit 200 performs feedback control on the torque of the winding motor M40 based on the detection result of the tension sensor S41 to adjust the winding tension Tc of the sheet S.

The printer control unit 200 also carries out a function of controlling the corona processing device 7. Specifically, the printer control unit 200 adjusts voltage applied to the corona discharge electrode 731 included in the corona charger 73. According to this, wettability of ink to the sheet S can be adapted by adjusting energy provided to a corona process.

Further, the printer control unit 200 carries out a function of controlling the steering mechanism 8 described above, and performs feedback control on the axial direction drive motor Ma based on the detection result of the edge sensor Se. Specifically, the printer control unit 200 performs steering control using a steering control block 210 and a storage unit 220 which are embedded as illustrated in FIG. 5.

Figure 5:
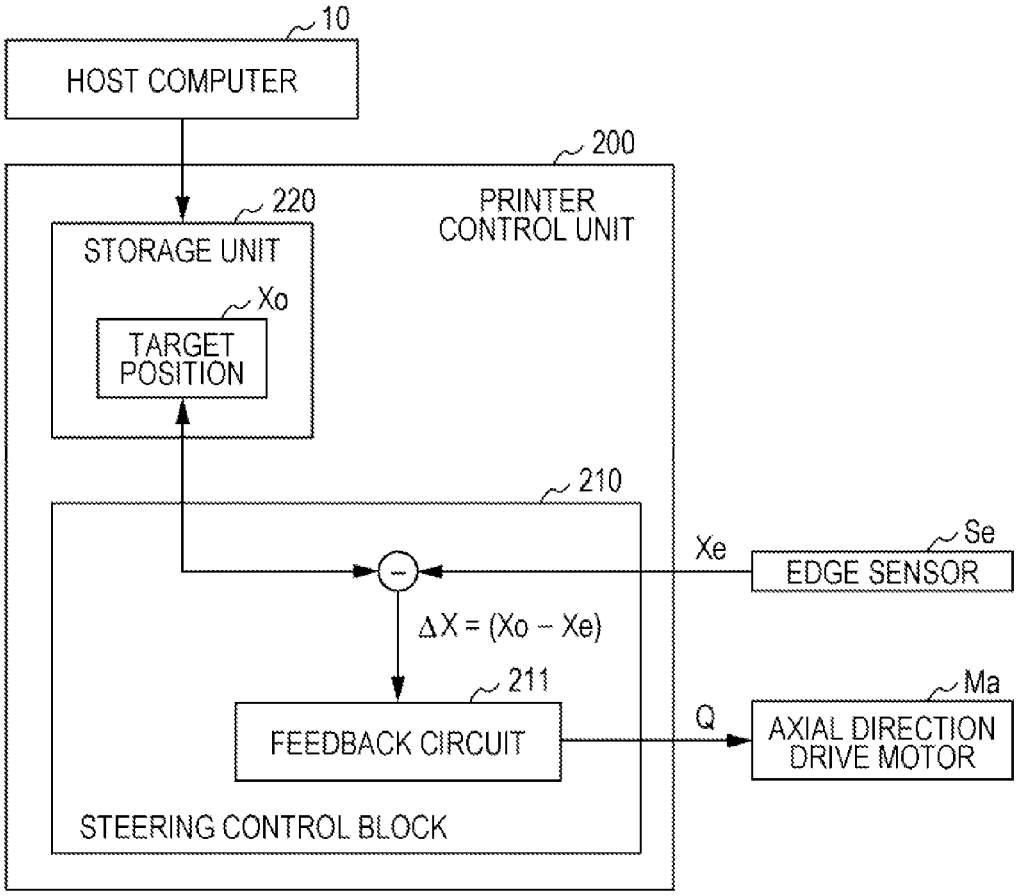
FIG. 5 is a block diagram illustrating an exemplary outline of an electrical configuration in which steering control is performed.

FIG. 5 is a block diagram illustrating an outline of an electrical configuration in which steering control is performed. The steering control block 210 provided in the printer control unit 200 calculates a deviation $\Delta X$ ($=Xo-Xe$) between a position Xe (that is, a detection result) of an end of the sheet S detected by the edge sensor Se in the axial direction Da and a target position Xo stored in the storage unit 220 to input the deviation $\Delta X$ to an embedded feedback circuit 211. Further, the feedback circuit 211 provides an operation amount Q ($=K\times\Delta X$) obtained by multiplying the deviation $\Delta X$ by a feedback gain K with the axial direction drive motor Ma. According to this, the axial direction drive motor Ma adjusts a position in the axial direction Da of the sheet S by displacing the feeding shaft 20 in the axial direction Da by an amount corresponding to the operation amount Q so that the deviation $\Delta X$ converges to zero (that is, the detected position Xe approaches to the target position Xo). In this manner, it becomes possible to adjust the position of the sheet S with high accuracy and appropriately control the position of the sheet S fed to the recording heads 51 and 52.

As described above, according to the embodiment configured in this manner, the support roller 71 that supports the sheet S subjected to the corona process between the feeding shaft 20 and the recording heads 51 and 52 displaces the sheet S according to the displacement of the feeding shaft 20 that feeds the sheet S. Accordingly, if the feeding shaft 20 is displaced, the support roller 71 is also displaced. Therefore, the support roller 71 interrupting the displacement of the sheet S accompanied by the displacement of the feeding shaft 20 can be suppressed. As a result, the position of the sheet S that is fed to the recording heads 51 and 52 can be properly controlled by smoothly displacing the sheet S according to the displacement of the feeding shaft 20 in the axial direction Da.

Further, according to the present embodiment, since the corona charger 73 is displaced according to the displacement of the support roller 71, the advantages are as follows. That is, if the sheet S is displaced according to the displacement of the support roller 71 and the positional relationship between the corona charger 73 and the sheet S is therefore changed, there is a concern that the corona process by the corona charger 73 may be affected. By contrast, if the corona charger 73 is displaced along with the displacement of the support roller 71, the change in the positional relationship between the corona charger 73 and the sheet S is suppressed, so the corona process can be stably performed.

In addition, according to the present embodiment, the nip portion N that nips the sheet S with a pair of the rollers 31 and 31*n* disposed between the feeding shaft 20 and the recording heads 51 and 52 is provided. In this manner, in the configuration in which the sheet S is nipped by the nip portion N disposed between the feeding shaft 20 and the recording heads 51 and 52, the position of the sheet S from the nip portion N to the feeding shaft 20 is adjusted according to the displacement of the feeding shaft 20. Also the positional change of the sheet S from the nip portion N to the recording heads 51 and 52 is suppressed by the nip so that the sheet S is stably fed to the recording heads 51 and 52. That is, the sheet S of which the position is adjusted until the sheet S reaches the nip portion N can be stably fed from the nip portion N to the recording heads 51 and 52. Further, the support roller 71 provided between the feeding shaft 20 and the nip portion N in order to support the sheet S subjected to the corona process is displaced according to the displacement of the feeding shaft 20. Therefore, the position of the sheet S can be appropriately adjusted until the sheet S reaches the nip portion N without being interrupted by the support roller 71 and also the sheet S can be stably fed from the nip portion N to the recording heads 51 and 52. As a result, the position of the sheet S that is fed to the recording heads 51 and 52 can be controlled more appropriately.

Others

In this manner, in the embodiment described above, the printer 1 corresponds to an example of "a printing apparatus" of the invention, the feeding shaft 20 corresponds to an example of a "rotating shaft" of the invention, the axial direction Da corresponds to an example of an "axial direction" of the invention, the recording heads 51 and 52 correspond to examples of a "print head" of the invention, the support roller 71 corresponds to an example of a "support member" of the invention, the corona processing device 7 corresponds to an example of a "process execution unit" of the invention, the corona process corresponds to an example of a "front surface modifying process" of the invention, the steering mechanism 8 corresponds to an example of a "displacement mechanism" of the invention, the sheet S corresponds to an example of a "recording medium" of the invention, the movable support member 81 and the axial direction drive motor Ma work in cooperation as an example of a "drive unit" of the invention, the nip portion N corresponds to an example of a "nip portion" of the invention, and the edge sensor Se corresponds to an example of a "detection unit" of the invention.

Figure 6:
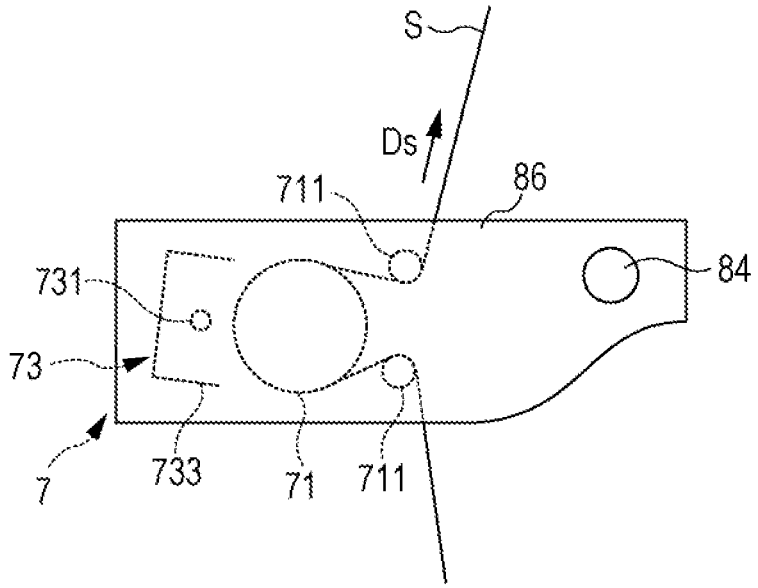
FIG. 6 is a front view schematically illustrating a modification of a corona processing device.

In addition, the invention is not limited to the embodiments as described above, but various modifications can be added to the item described above as long as they do not depart from the scope of the invention as defined by the appended claims. For example, the configuration of the corona processing device 7 may be modified as illustrated in FIG. 6. FIG. 6 is a front view schematically illustrating a modification of a corona processing device. In FIG. 6, portions hidden by the mounting flat plates 86 in the front view (the corona processing device 7 and a part of the sheet S) are illustrated by dashed lines like in FIG. 3.

The corona processing device 7 illustrated in FIG. 6 is different from the corona processing device 7 described above in that driven rollers 711 having small diameters are provided on both sides of the support roller 71, respectively. That is, the driven rollers 711 wind the front surface of the sheet S at both upstream and downstream sides of the support roller 71 in the transportation direction Ds so that the sheet S is folded back. According to the configuration, the portion of the sheet S wound around the support roller 71 can be secured to be long. In addition, each of the driven rollers 711 is interposed between two mounting flat plates 86 and supported integrally with each of the members 71 and 73 that are included in the corona processing device 7. Accordingly, not only the support roller 71 but also the driven rollers 711 can be displaced in the axial direction Da according to the displacement of the feeding shaft 20 in the axial direction Da. Accordingly, the sheet S can be smoothly displaced according to the displacement of the feeding shaft 20 without being interrupted by the support roller 71 and the driven rollers 711.

Further, in the embodiment described above, the steering mechanism 8 displaces the support roller 71 according to the displacement of the feeding shaft 20 by integrally driving the feeding shaft 20 and the support roller 71. However, for example, the steering mechanism 8 may be configured so that the support roller 71 is displaced according to the displacement of the feeding shaft 20 by respectively providing motors to the feeding shaft 20 and the support roller 71 and independently driving the feeding shaft 20 and the support roller 71 with the corresponding motors. At this point, the displacement amounts of the feeding shaft 20 and the support roller 71 may be the same. Alternatively, if the feeding shaft 20 and the support roller 71 are displaced to the same side in the axial direction Da, the displacement amounts of the feeding shaft 20 and the support roller 71 can be different. Specifically, the displacement amount of the support roller 71 in the axial direction Da may be smaller or larger than the displacement amount of the feeding shaft 20 in the axial direction Da.

In addition, in the embodiment described above, the front drive roller 31 among the pair of rollers 31 and 31*n* that configure the nip portion N is a drive roller that receives drive force from the front drive motor M31. However, neither of the pair of rollers 31 and 31*n* that configures the nip portion N need necessarily be a drive roller and both of the rollers may be driven rollers.

In other words, the nip portion N is not an essential element. Accordingly, the nip portion N need not be provided between the feeding shaft 20 and the recording heads 51 and 52. In addition, in a configuration in which the nip portion N is not provided, a drive roller may be provided between the feeding shaft 20 and the recording heads 51 and 52 like the front drive roller 31 (FIG. 1) in the embodiment described above.

That is, in a configuration in which the front drive roller 31 winds the sheet S between the feeding shaft 20 and the recording heads 51 and 52 to feed the sheet S to the recording heads 51 and 52, the position of the sheet S from the front drive roller 31 to the feeding shaft 20 is adjusted according to the displacement of the feeding shaft 20 and the sheet S is stably fed to the recording heads 51 and 52 by driving the front drive roller 31 from the front drive roller 31 to the recording heads 51 and 52. That is, the sheet S of which the position is adjusted until the sheet S reaches the front drive roller 31 can be stably fed from the front drive roller 31 to the recording heads 51 and 52. Further, the support roller 71 provided between the feeding shaft 20 and the front drive roller 31 in order to support the sheet S subjected to the corona process is displaced according to the displacement of the feeding shaft 20. Therefore, the position of the sheet S is appropriately adjusted until the sheet S reaches the front drive roller 31 without being interrupted by the support roller 71, and then the sheet S can be stably fed from the front drive roller 31 to the recording heads 51 and 52. As a result, the position of the sheet S fed to the recording heads 51 and 52 can be controlled more appropriately.

In addition, according to the embodiment described above, the corona charger 73 is displaced integrally with the feeding shaft 20. However, the corona charger 73 can be fixed independently of the displacement of the feeding shaft 20.

Further, according to the embodiment described above, the driven roller 21 is provided between the support roller 71 and the front drive roller 31. However, the driven roller 21 need not be provided.

In addition, according to the embodiment described above, the support roller 71 is displaced by receiving drive force of the axial direction drive motor Ma. However, the support roller 71 may be configured to be displaced according to the displacement of the feeding shaft 20 by configuring that the support roller 71 is supported by an elastic member such as a spring, and the support roller 71 is displaced by receiving a reaction of the sheet S.

Various changes to a disposition position and the number of the edge sensor Se can be made. In addition, various types of sensors such as an optical sensor or a ultrasonic sensor can be used as a type of edge sensor Se.

In addition, according to the embodiment described above, a case in which the corona process is performed as a front surface modifying process is described as an example. However, details of the front surface modifying process are not limited to the corona process. Accordingly, it may be configured so that a front surface modifying process such as plasma processing or a front surface treatment of coating a liquid is performed.

The foregoing description has been given by way of example only and it will be appreciated by a person skilled in the art that modifications can be made without departing from the scope of the present invention.

What is claimed is:

1. A printing apparatus comprising:

a rotating shaft that is adapted to feed a recording medium by rotating;

a print head for printing on the recording medium that is fed from the rotating shaft;

a support member for supporting the recording medium between the rotating shaft and the print head;

a process execution unit for performing a front surface modifying process on the recording medium supported by the support member; and a displacement mechanism for displacing the support member in an axial direction of the rotating shaft according to displacement of the medium.

2. The printing apparatus according to claim 1, wherein the process execution unit is adapted to displace according to displacement of the support member.

3. The printing apparatus according to claim 1, further comprising:

a nip portion for nipping the recording medium with a pair of rollers disposed between the rotating shaft and the print head, wherein the support member is adapted to support the recording medium between the rotating shaft and the nip portion.

4. The printing apparatus according to claim 1, further comprising:

a drive roller for supporting the recording medium between the rotating shaft and the print head and feeding the recording medium to the print head, wherein the support member is adapted to support the recording medium between the rotating shaft and the drive roller.

5. The printing apparatus according to claim 1, further comprising:

a detection unit for detecting a position of the recording medium in the axial direction of the rotating shaft, wherein a displacement amount of the support member in the axial direction is adapted to be controlled based on a detection result of the detection unit.

6. A printing method for printing by a print head on a recording medium that is fed from a rotating shaft to the print head, the method comprising:

feeding the recording medium by rotating the rotating shaft;

performing a front surface modifying process on the recording medium supported by a support member between the rotating shaft and the print head; and printing by the print head on the recording medium that is fed to the print head after being subjected to the front surface modifying process, wherein the support member is displaced in an axial direction of the rotating shaft according to displacement of the medium.

* * * * *